United States Patent [19]

Voland et al.

[11] 4,406,932

[45] Sep. 27, 1983

[54] CAM OPERATED TIMER WITH IMPROVED ELECTRICAL CONNECTIONS

[75] Inventors: Elmo W. Voland, Indianapolis; George W. Adams, Greenwood, both of Ind.

[73] Assignee: Emhart Industries, Inc., Indianapolis, Ind.

[21] Appl. No.: 263,294

[22] Filed: May 13, 1981

[51] Int. Cl.[3] ..... H01H 43/10

[52] U.S. Cl. ..... 200/38 R; 200/38 B

[58] Field of Search ..... 200/38 R, 38 B, 38 BA, 200/283, 284

[56] References Cited

U.S. PATENT DOCUMENTS

| | | | |
|---|---|---|---|
| 3,627,937 | 12/1971 | Swanke et al. | 200/38 B |
| 3,727,015 | 4/1973 | Voland et al. | 200/283 X |
| 3,823,280 | 7/1974 | Obermann et al. | 200/38 B |
| 4,123,915 | 11/1978 | Stoor | 200/38 B X |

*Primary Examiner*—J. R. Scott

*Attorney, Agent, or Firm*—Robert F. Meyer; David W. Gomes

[57] ABSTRACT

The electrical connections illustrated in U.S. Pat. No. 3,727,015 have been improved by providing a means of holding the combination electrical terminals and electrical blades in a housing wall to provide more positive electrical connections and by providing a means to connect electrical leads to the combination within the wall.

4 Claims, 4 Drawing Figures

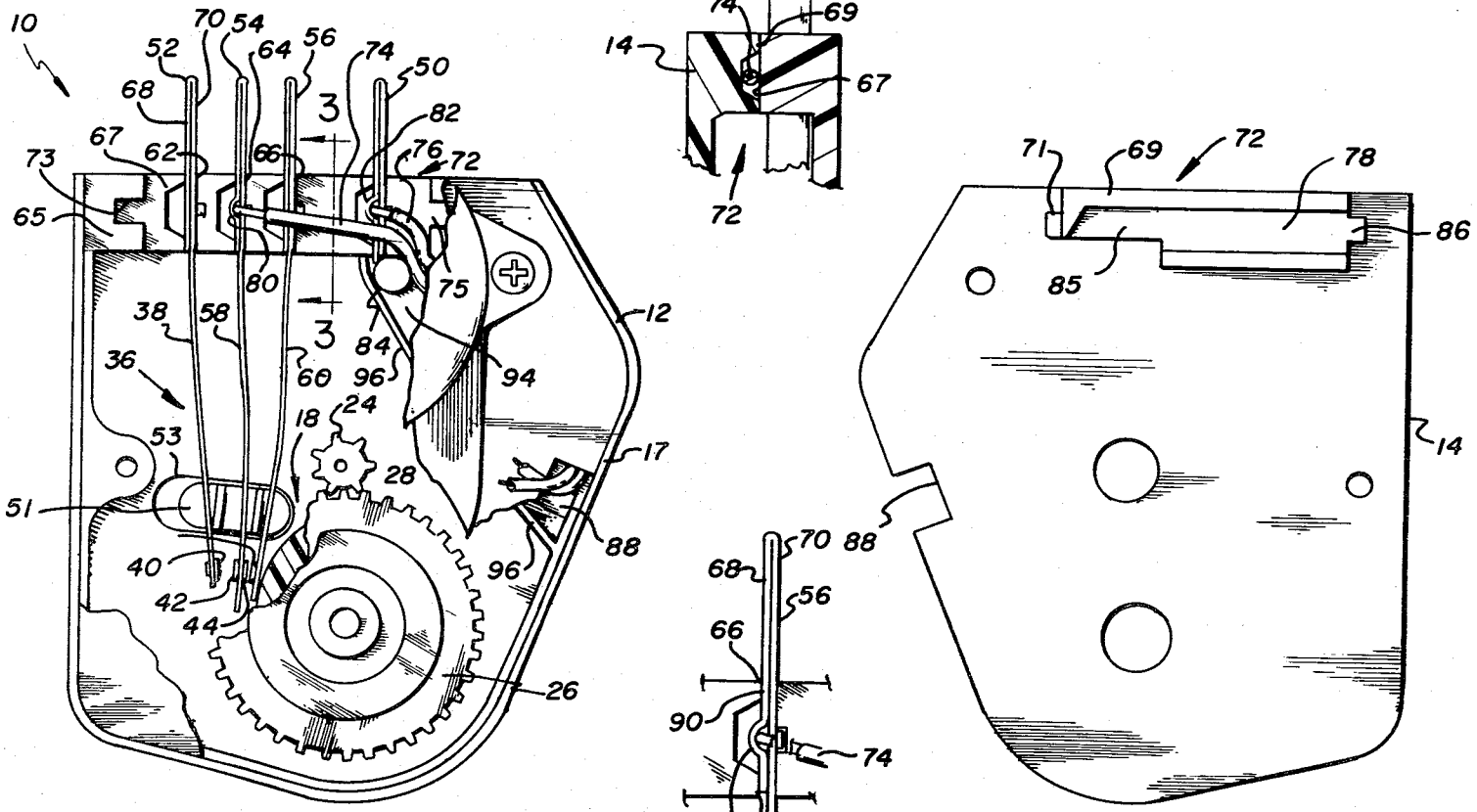
FIG.1
FIG.2
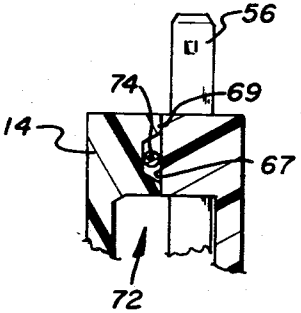
FIG.3
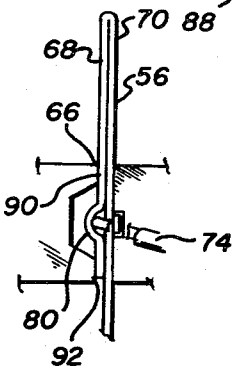
FIG. 4

CAM OPERATED TIMER WITH IMPROVED ELECTRICAL CONNECTIONS

BACKGROUND OF THE INVENTION

Generally speaking, the present invention pertains to a timer having a motor driven cam programming means; a housing carrying the cam programming means including surrounding walls and end plates cooperating with the surrounding walls; at least one combination electrical terminal and electrical contact blade including a pair of legs, at least a portion of which are in a side-by-side relationship; at least one slot in at least one wall of the surrounding walls, the slot having a thickness in portions thereof sufficient only to receive the pair of legs in an interference fit to compress them together in a tight relationship; whereby a combination electrical terminal and electrical blade is provided with a good positive electrical connection between the pair of legs.

The invention also contemplates a connecting means carried within the wall of the housing to connect electrical leads to the combination electrical blade and electrical terminal.

Defrost timers have long been used in appliances such as refrigerators to defrost them in accordance with a predetermined program cycle. In the manufacture of these timers, industry is constantly striving to make the timers as small and compact as possible with a minimum number of parts. Also, the industry is highly competitive and, therefore, the most economical fabrication methods are constantly being sought.

A timer which, for the most part, admirably meets these requirements is that discussed and claimed in U.S. Pat. No. 3,727,015 issued Apr. 10, 1973 to Elmo W. Voland, et al. As described in the patent, there are combination electrical blades and electrical terminals which are held in a housing for the timer through the use of projections lanced from the combination and received in notches provided in the housing wall. The present invention represents an improvement over this type of structure. In addition, as shown and discussed in the patent, the electrical leads for the timer motor are connected to the combination electrical terminal and electrical blades through a quick disconnect means that is located inside the housing adjacent the housing wall. While this construction is suitable, it does create an electrical hazard.

OBJECTS OR FEATURES OF THE INVENTION

It is therefore, a feature of the present invention to provide a timer which is simple and economical to produce. Another feature of the invention is to provide such a timer having combination electrical blades that are respective to a cam programming means and electrical terminals that are carried by a wall of a housing for the timer. Another feature of the invention is to provide such a timer wherein the combination includes a pair of legs at least a portion of which are in a side-by-side relationship which can be compressed together. Yet another feature of the invention is to provide such a timer wherein there are slots in the housing wall with portions of the slots being of sufficient thickness to receive the pair of legs of the combination in an interference fit to compress them together in a tight relationship. Another feature of the invention is to provide such a timer wherein there is a connecting means carried within the wall of the housing for connecting electrical leads to the combination electrical blade and electrical terminal within the wall. Still another feature of the invention is to provide such a timer wherein there is also a compartment within the wall which carries the electrical leads and directs it away from the combination electrical terminal and electrical blade. Another feature of the invention is to provide such a timer wherein the electrical leads are leads from the motor for the timer, the leads being directed from the motor into a compartment within the housing and into the wall carrying the combination electrical terminal and electrical blade. These and other features of the invention will become apparent from the following description taken in conjunction with the accompanying drawings.

BRIEF DESCRIPTION OF THE DRAWINGS

FIG. 1 is a front view of a timer with portions thereof being removed to show the various elements of the timer.

FIG. 2 is a bottom view of a cover for the timer.

FIG. 3 is a section taken along the line 3—3 of FIG. 1.

FIG. 4 is an enlarged view of a portion of a wall of a housing for the timer.

DETAILED DESCRIPTION OF THE INVENTION

The timer 10 utilizing the concepts of the present invention is completely described in the aforementioned U.S. Pat. No. 3,727,015 and, therefore, in the interest of simplicity, its complete description will not be presented.

The various elements of timer 10 are enclosed in a housing 12 the housing being formed from a cup-shaped member 17 which is closed by a cover plate 14. A constant speed motor (not shown) is connected to cover plate 14, the motor being used to drive a cam programming means 18. Switch means 36 which includes a plurality of switch blades 38, is responsive to cam programming means 18. Switch blades 38, 58 and 60 carry electrical contacts 40, 42, 44 and 46 such that when the contacts are brought together in a predetermined sequence, an electrical circuit can be completed through the blades to electrical terminals 50, 52, 54 and 56. The blades are separated by a slidable separating means 51 which is mounted in a suitable aperture 53 molded in the housing 17. As more completely described in U.S. Pat. No. 3,727,015 rotation of cam programming means 18 causes the contacts 40, 42, 44 and 46 to be engaged in a predetermined programmed sequence.

In accordance with the present invention, terminals 52, 54 and 56 are provided as a one-piece construction with blades 38, 58 and 60 and are held in slots 62, 64 and 66 of wall 65 of housing 12. Wall 65 includes a cut-away portion 67 and a mating projection 69 extending from cover 14. Projection 69 is held in the cut-away portion through tongue and groove connections 86, 73 and 71, 75.

Each one piece spring, terminal and contact assembly construction includes a single strip of material, a portion of which is lapped over to provide legs 68 and 70 in a side-by-side relationship, the legs forming the terminal portions 52, 54 and 56. Referring to FIG. 4, the legs are held in slots 62, 64 and 66 by virtue of an interference fit. More specifically, the thickness at portions 90 and 92 of the slots is such that the legs 68 and 70 must be very tightly pressed together to engage and be held in the slots. This represents a decided improvement over the structure of the above-noted U.S. Pat. No. 3,727,015 in that a more positive electrical connection is provided between the legs.

In accordance with another feature of the invention, the structure of U.S. Pat. No. 3,727,015 has been improved by providing a means 72 to permit motor electrical leads 74 and 76 to be electrically connected to the combination within wall 65 of the housing, thus providing a safer timer, electrically. As shown, electrical leads 74 and 76 are fed through a groove 78 provided in projection 69 to the combination terminals 50 and 54 where connection is to be made. Electrical leads 74 and 76 optionally may be connected to any of the combination terminals 50, 52, 54 or 56 depending upon the mode of timer operation desired. The leads are connected to jacks 80 and 82 formed in one of the legs of the combination terminal and blade. Groove 78 is provided substantially normal to the axial length of the blades 56 such that the leads are directed away from the blades. To further insure that the leads will not be in close proximity to the blades, a guide post 84 extends from the base of cup-shaped member 17 near the exit end 85 of groove 78. From guide post 84, the leads are directed into compartment 94 provided by wall 96 to further insure that the leads will not be in close proximity to the blades. As shown, the leads then exit from the housing through aperture 88 provided in plate 14.

What is claimed is:

1. In a timer having motor driven cam programming means, (a) a housing carrying said cam programming means including surrounding walls and end plates cooperating with said surrounding walls and a cover engaging said walls, (b) at least one combination electrical terminal and electrical contact blade engaging said cam programming means including a pair of legs, at least a portion of which are in a side-by-side relationship, (c) at least one slot in at least one wall of said surrounding walls and a cavity in said wall opening to said slot, (d) a jack formed in one of said legs extending into said slot and receiving an electrical lead, (e) a groove in said cover disposed in a direction substantially normal to an axial length of said electrical contact blade and receiving said electrical lead, and (f) an aperture in said housing remote from said jack through which said electrical lead extends.

2. In a timer according to claim 1 wherein said groove is provided in a projection of said cover extending into said wall.

3. In a timer according to claim 2 further including a post located near said groove further directing said electrical lead toward said aperture.

4. In a timer according to claim 1 further including a wall inside said housing providing a compartment for said electrical lead between said groove and said aperture.

* * * * *